US006267339B1

(12) United States Patent
Gates et al.

(10) Patent No.: US 6,267,339 B1
(45) Date of Patent: Jul. 31, 2001

(54) PIVOTALLY JOINED BRACKET

(76) Inventors: William George Gates, 60 Gloucester Road, Milton Keynes MK12 5DX; Anthony John Hutton, 39 Llanwern Road, Royal Oak, Newport NP9 5GF; Anthony James Skeats, 50 Great Pulteney Street, 1st Floor Flat Bath, BA2 4DP, all of (GB)

( * ) Notice: Subject to any disclaimer, the term of this patent is extended or adjusted under 35 U.S.C. 154(b) by 0 days.

(21) Appl. No.: 09/260,773

(22) Filed: Mar. 2, 1999

(30) Foreign Application Priority Data

Mar. 4, 1998 (EP) ..... 98301595

(51) Int. Cl.[7] ..... A47B 96/06
(52) U.S. Cl. ..... 248/218.4; 248/230.8
(58) Field of Search ..... 248/534, 535, 248/540, 541, 74.1, 229.17, 230.8, 154, 536, 539, 311.2, 218.4; 403/54, 62; 343/878, 890, 892

(56) References Cited

U.S. PATENT DOCUMENTS

| | | | | |
|---|---|---|---|---|
| 1,924,033 | * | 8/1933 | Flor | 248/539 |
| 2,731,223 | * | 1/1956 | Riccio | 248/511 |
| 3,094,303 | * | 6/1963 | Belger | 248/514 |
| 3,632,070 | * | 1/1972 | Thayer | 248/74.3 |
| 3,632,071 | * | 1/1972 | Cameron | 248/74.3 |
| 5,423,281 | * | 6/1995 | Crookham et al. | 248/218.4 |

FOREIGN PATENT DOCUMENTS

| | | | |
|---|---|---|---|
| 9403574 U | | 3/1994 | (DE) . |
| 2248623 | * | 10/1973 | (FR) . |
| 2 745 423 | | 2/1996 | (FR) . |
| 2231484 | | 11/1990 | (GB) . |
| 9619558 | | 9/1996 | (GB) . |
| PCT/SE97/ 00207 | | 2/1997 | (WO) . |

OTHER PUBLICATIONS

European Search Report dated Aug. 10, 1998.

* cited by examiner

*Primary Examiner*—Anita M. King
*Assistant Examiner*—Gwendolyn Baxter

(57) ABSTRACT

A bracket is disclosed for mounting one object on another. The bracket has two pivotally joined links, one for receiving said one object. Each link is pivotally joined to a respective fixing member for fixing to the other object. The pivotal joints have parallel pivotal axes so that the distance at which the fixing members are spaced, when fixed to the other object determines the angular orientation of said one object relative to the other.

4 Claims, 3 Drawing Sheets

PIVOTALLY JOINED BRACKET

CROSS-REFERENCE TO RELATED APPLICATION

This application claims priority of European Patent Application No. 98301595.9, which was filed on Mar. 04,1998.

1. Field of the Invention

This invention relates to brackets.

2. Description of the Related Art

The background to the invention will be described with reference to a particular application. Other applications may occur readily to the reader.

Cellular mobile telecommunications networks utilize directional antennas which serve a sector, generally 120°, of a cell which is usually hexagonal. The antenna may be incorporated in a single unit with an associated processor, a transmitter and a receiver. The antenna is required to be directed at the intended sector and, additionally, slightly downwardly

SUMMARY OF THE INVENTION

Against this background there is provided a bracket for mounting one object on another, comprising two pivotally joined links, one for receiving said one object; each link being pivotally joined to a respective fixing member for fixing to the other object, the pivotal joints having parallel pivotal axes so that the distance at which the fixing members are spaced, when fixed to the other object determines the angular orientation of said one object relative to the other.

In order to avoid the possibility that slippage could alter the angle of the unit, one of the joints preferably includes at least one hole in each member, the holes being so aligned that a pin may be passed through both to fix the joint.

In order to facilitate fixing the bracket to a pole, the fixing members preferably have means to receive a strap.

The invention extends to base station equipment for a cellular mobile telecommunications network, including a directional antenna and being fixed to a structure, e.g. a pole, by a bracket of the invention.

BRIEF DESCRIPTION OF THE DRAWING

One embodiment of the invention will now be described, by way of example, with reference to the accompanying drawings, in which.

DETAILED DESCRIPTION

Figure 3:
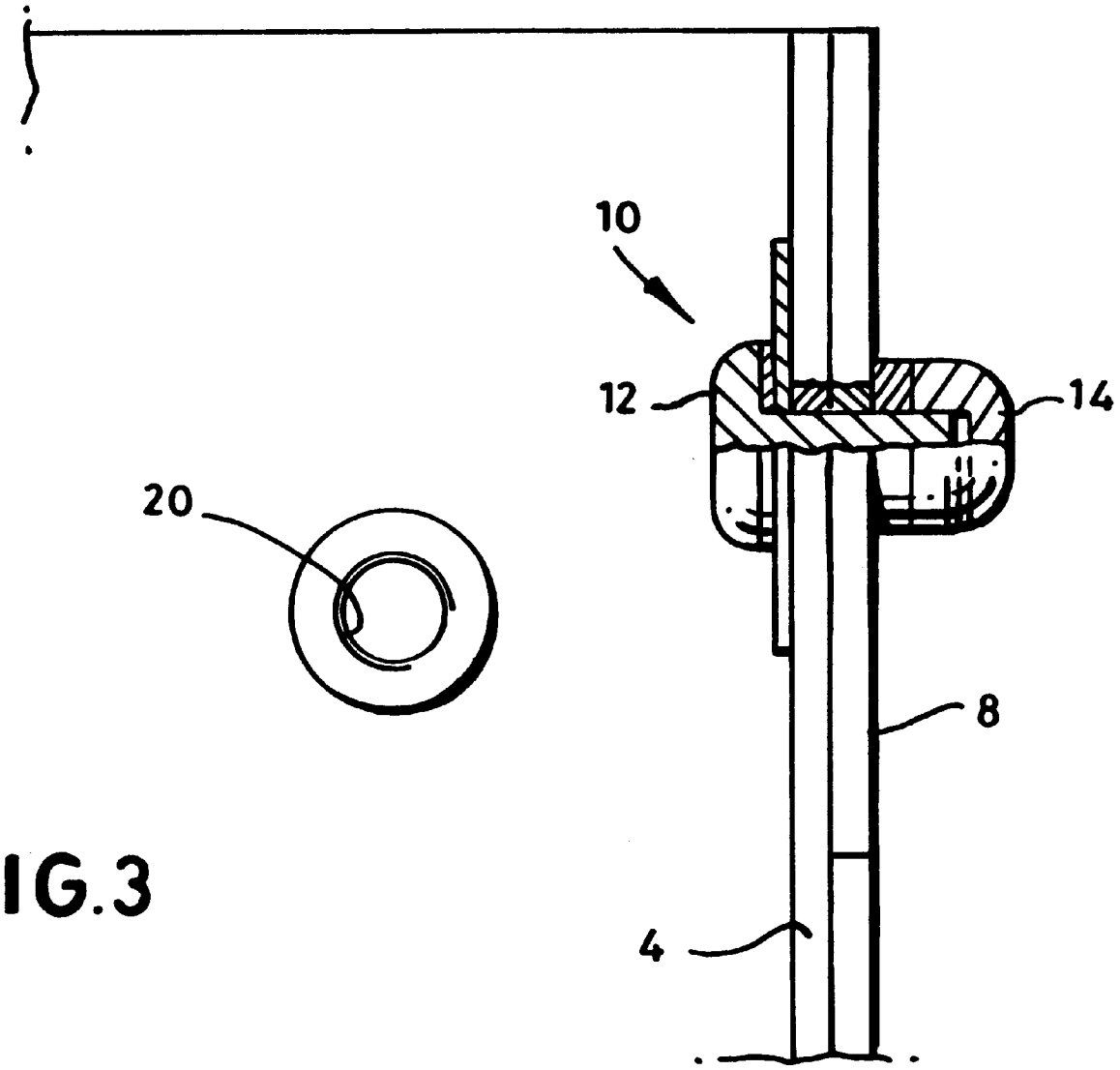
FIG. 3 is a scrap section through a joint of the bracket of FIG. 1.

Referring to the drawings, a bracket 2 has two links 4 and 6. The link 6 comprises a metal pressing which has two lugs 8 on both ends to provide a U-shaped cross section. The link 4 is pivotally joined to the upper end of the link 6. As shown, the link 4 comprises two members 4*a* and 4*b*. One end of each member 4*a* and 4*b* is joined to a respective lug 8 by a pivot pin 10 retained by a head 12 and a washer 14 (see FIG. 3) and by fasteners 44 through holes 46 in the respective member and through holes 48 in the respective lug.

The other ends of both links 4 and 6 are pivotally joined to lugs 16 of two U-shaped fixing members 18.

Four threaded bushes 20 (only three can be seen in the drawing) receive machine screws to secure a base station unit 22 to the bracket. The base station unit contains a processor, a transmitter and a receiver amongst other things not shown, and a flat plate directional antenna 24 mounted inside the case 26 of the unit 22.

In use the fixing members 18 are secured to a structure on which the unit 22 is to be mounted. The fixing members may be secured directly to the structure by bolts, for example, through holes 28. Alternatively, the fixing members 18 can be adapted by adapters 30 for strapping to a pole. Each adapter 30 comprises a plate 32 which is bolted to the U-shaped fixing member through the holes 28. At its centre, the plate 32 is pressed in a W-shape 34 to provide a central recess 36. In use, the pole is received by the recess 36 and the plate 32 is strapped to the pole by straps 38 which pass through holes 40 in the outer arms 42 of the W-shape.

Figure 1:
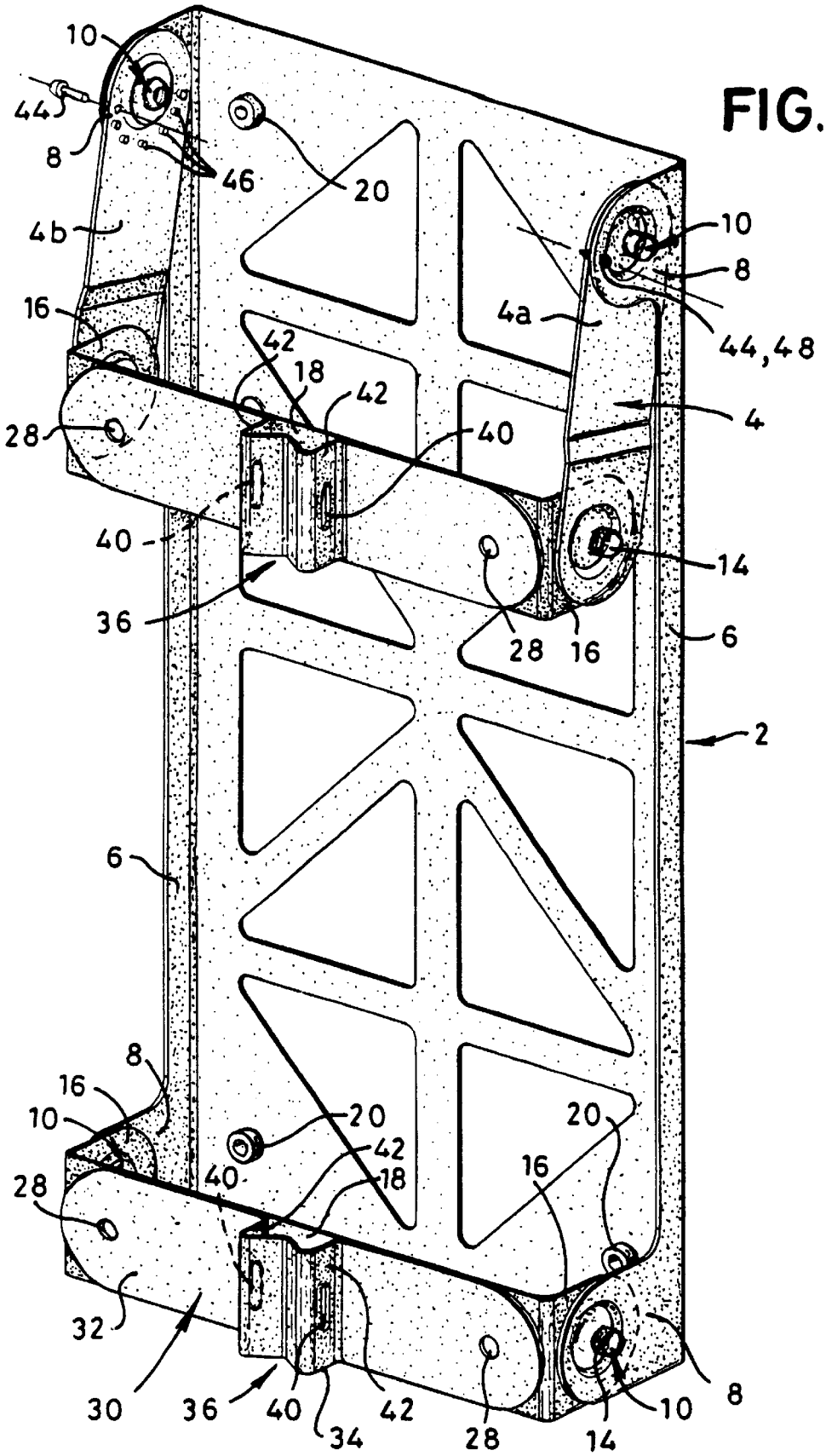
FIG. 1 is a pictorial view of a bracket embodying the invention.
Figure 2:
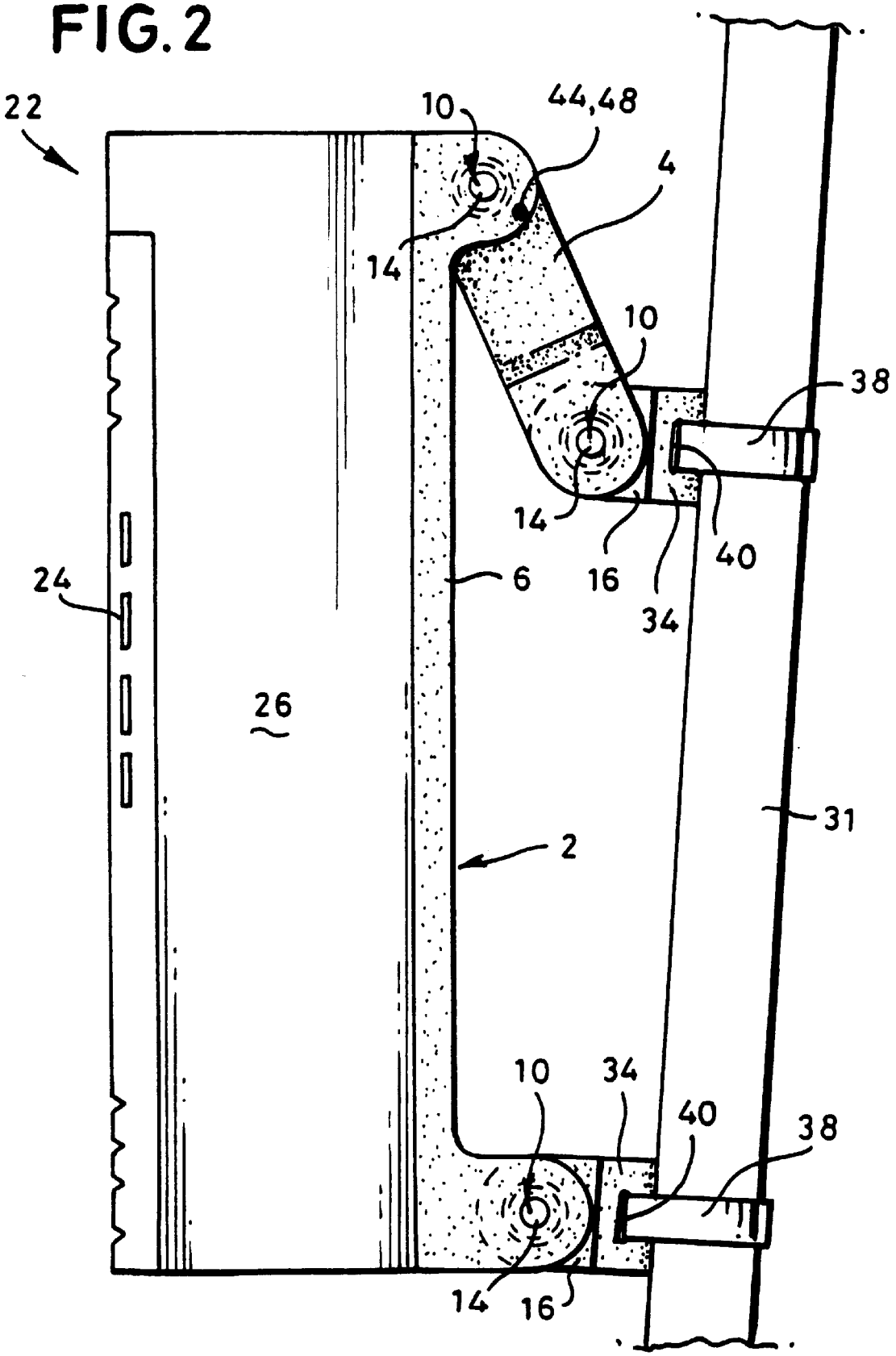
FIG. 2 is a side of the bracket of FIG. 1 in use mounting base station equipment on a pole.

As will be appreciated from FIG. 2, the closer the fixing members 18 are set on the pole or other structure, the closer to vertical is the unit 22 and thus the plate antenna 24. Conversely, the further the fixing members are spaced, the further the unit 22 is declined from vertical.

The invention claimed is:

1. A bracket for mounting one object on at least one other object, the bracket comprising:

two pivotally joined links, a first one of the links for receiving said one object;

each of the two links being pivotally joined by at least one pivotal joint to a respective fixing member for fixing to the other object, the pivotal joints having parallel pivotal axes so that a distance at which the fixing members are spaced, when fixed to the other object, determines the angular orientation of the first one of the links relative to the fixing members;

wherein a second one of the links comprises two separate members side by side each pivotally joined to the first one of the links and to the associated fixing member.

2. The bracket as claimed in claim 1, wherein one of the pivotal joints includes at least one hole in one of the members and at least one hole in the first one of the links, the at least one hole in one of the members and the at least one hole in the first one of the links being so aligned that the pivotal joint is joined by a pin passed through the at least one hole in one of the members and the at least one hole in the first one of the links.

3. The bracket as claimed in claim 1, wherein the fixing members have means to receive a strap for fixing to a pole.

4. Base station equipment for a cellular mobile telecommunications network, including a directional antenna and being fixed to a structure by the bracket as claimed in claim 1.

* * * * *